US011335237B2

(12) United States Patent
Okabe et al.

(10) Patent No.: US 11,335,237 B2
(45) Date of Patent: May 17, 2022

(54) DISPLAY DEVICE

(71) Applicant: SHARP KABUSHIKI KAISHA, Osaka (JP)

(72) Inventors: Tohru Okabe, Osaka (JP); Takeshi Yaneda, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 17/280,164

(22) PCT Filed: Sep. 28, 2018

(86) PCT No.: PCT/JP2018/036446
§ 371 (c)(1),
(2) Date: Mar. 25, 2021

(87) PCT Pub. No.: WO2020/065961
PCT Pub. Date: Apr. 2, 2020

(65) Prior Publication Data

US 2021/0343226 A1 Nov. 4, 2021

(51) Int. Cl.
*G09G 3/20* (2006.01)
*G09G 3/3266* (2016.01)
*G09G 3/3291* (2016.01)

(52) U.S. Cl.
CPC ..... *G09G 3/2092* (2013.01); *G09G 3/3266* (2013.01); *G09G 3/3291* (2013.01); *G09G 2320/0219* (2013.01); *G09G 2330/028* (2013.01)

(58) Field of Classification Search
CPC ..... G09G 2320/0219
See application file for complete search history.

(56) References Cited

U.S. PATENT DOCUMENTS

| | | | | |
|---|---|---|---|---|
| 9,437,136 | B2 * | 9/2016 | Kumeta | G09G 3/3258 |
| 2011/0227889 | A1 * | 9/2011 | Choi | G09G 3/3233 345/209 |
| 2015/0154941 | A1 | 6/2015 | Kanda et al. | |
| 2018/0130409 | A1 * | 5/2018 | Xiang | G09G 3/3225 |
| 2018/0130410 | A1 * | 5/2018 | Gao | G09G 3/3225 |

FOREIGN PATENT DOCUMENTS

JP 2014-109707 A 6/2014

* cited by examiner

*Primary Examiner* — Sepehr Azari
(74) *Attorney, Agent, or Firm* — ScienBiziP, P.C.

(57) ABSTRACT

A pixel circuit including a drive transistor and a capacitor electrically connected to a control terminal of the drive transistor, a light-emitting element, a first power supply voltage line intersecting a data signal line, and a second power supply voltage line electrically connected to the control terminal via the capacitor are provided, and in a writing period in which a scanning signal line becomes active, the first power supply voltage line and a second conduction terminal of the drive transistor are not conductive with each other, and in a light emission period of the light-emitting element, the first power supply voltage line and the second conduction terminal of the drive transistor are conductive with each other.

17 Claims, 11 Drawing Sheets

Prior Art

DISPLAY DEVICE

TECHNICAL FIELD

The disclosure relates to a display device.

BACKGROUND ART

PTL 1 discloses a pixel circuit of a display device including a light emitting diode.

CITATION LIST

Patent Literature

PTL 1: JP 2014-109707 A (published on Jun. 12, 2014)

SUMMARY

Technical Problem

In a configuration of PTL 1, due to parasitic capacitance formed in an intersection portion of a power source line through which power supply is supplied to a pixel circuit and a data signal line, a ripple occurs at potential of the power source line at the time of writing a data signal in the pixel circuit, and there is a possibility that a written data signal fluctuate (be pushed up or be pulled in) until a light emission period.

Solution to Problem

The present display device is a display device including a plurality of scanning signal lines, a plurality of light emission control lines, a plurality of first power supply voltage lines, a plurality of initialization power source lines, a plurality of data signal lines, and a plurality of second power supply voltage lines, wherein the plurality of scanning signal lines, the plurality of light emission control lines, the plurality of first power supply voltage lines, and the plurality of initialization power source lines extend in parallel, and each intersects the plurality of data signal lines and the plurality of second power supply voltage lines that extend in parallel, a plurality of subpixels each including a pixel circuit and a light-emitting element are provided corresponding to a plurality of intersection points of the plurality of scanning signal lines and the plurality of data signal lines, the pixel circuit includes a drive transistor, a threshold value compensation transistor, a power supply connection transistor, a writing transistor, and a capacitor, one electrode of the capacitor is electrically connected to a control terminal of the drive transistor, and the other electrode of the capacitor is electrically connected to each of the plurality of second power supply voltage lines, the power supply connection transistor includes a first conduction terminal electrically connected to each of the plurality of first power supply voltage lines, in a writing period of the pixel circuit, an ON voltage is input to a corresponding scanning signal line of the plurality of scanning signal lines, a data signal is input from a corresponding data signal line of the plurality of data signal lines to the capacitor via the writing transistor and the threshold value compensation transistor, and the other electrode of the capacitor is not conductive with each of the plurality of first power supply voltage lines, and in a light emission period of the light-emitting element, an ON voltage is input to a corresponding light emission control line of the plurality of light emission control lines, and in at least a partial period of the light emission period, the other electrode of the capacitor is conductive with each of the plurality of first power supply voltage lines via the power supply connection transistor.

Advantageous Effects of Disclosure

According to an aspect of the disclosure, a possibility that a written data signal fluctuate until a light emission period reduces.

DESCRIPTION OF EMBODIMENTS

Figure 1:
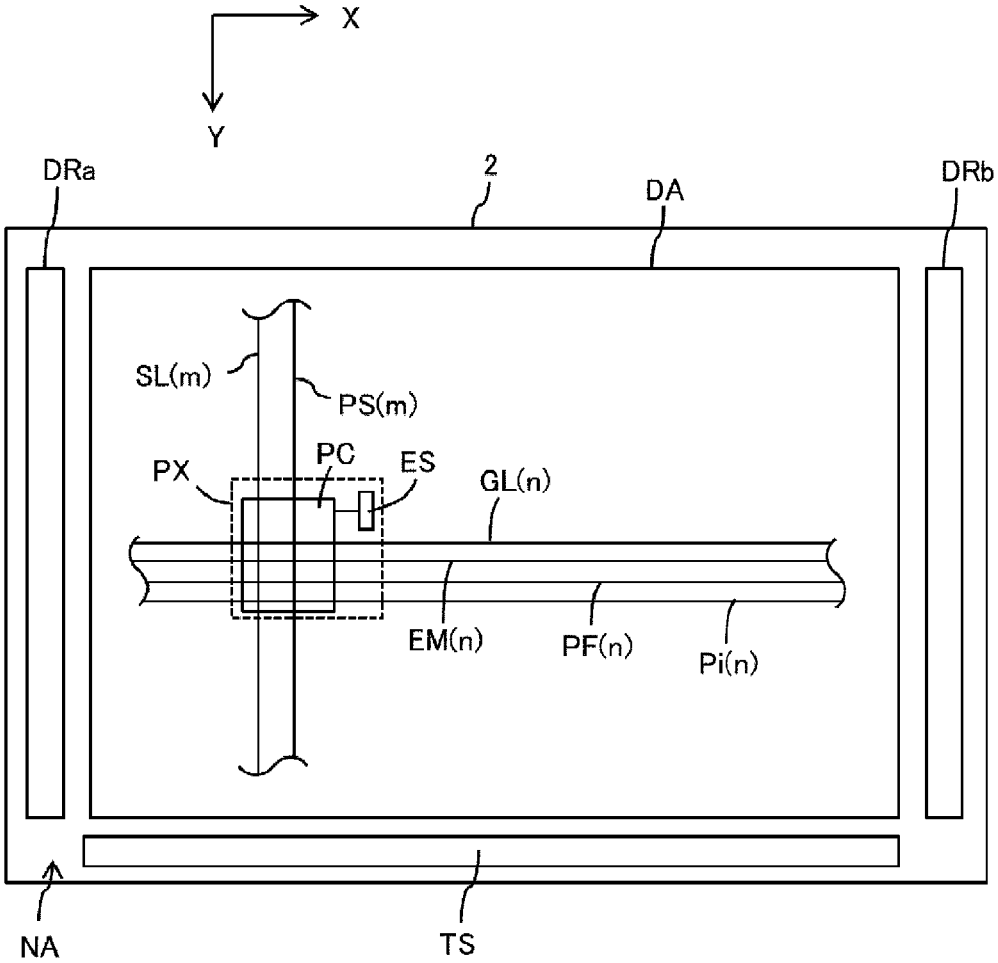
FIG. 1 is a schematic plan view illustrating a configuration of a display device of a first embodiment.

FIG. 1(*a*) is a schematic plan view illustrating a configuration of a display device. Hereinafter, it is assumed that K and L each represent an integer equal to or greater than 2, m represents an integer of 1 or more and K or less, and n represents an integer of 1 or more and L or less. As illustrated in FIG. 1, a display device 2 includes a display region DA and a frame region NA surrounding the display region DA. The display region DA includes a subpixel PX (nth row and mth column address) including a light-emitting element ES and a pixel circuit PC, a scanning signal line GL(n), a light emission control line EM(n), a first power supply voltage line PF(n) and an initialization power source line Pi(n) that are electrically connected to the pixel circuit PC and that extend in an X direction, and a data signal line SL(m) and a second power supply voltage line PS(m) that are electrically connected to the pixel circuit PC and that extend in a Y direction (orthogonal to the X direction). The subpixel PX is provided corresponding to an intersection portion of the scanning signal line GL(n) and the data signal line SL(m), and intersects the data signal line SL(m) and the first power supply voltage line PF(n).

Note that K lines of each of the scanning signal line, the light emission control line, the first power supply voltage line PF, and the initialization power source line are provided, and L lines of each of the data signal line and the second power supply voltage line are provided, and K×L subpixels are provided. The X direction is also referred to as a row direction and the Y direction is also referred to as a column direction.

The frame region NA is provided with driver circuits DRa and DRb disposed in both sides of the display region DA, and a terminal section TS. An external substrate is mounted on the terminal section TS.

First Embodiment

Figure 2:
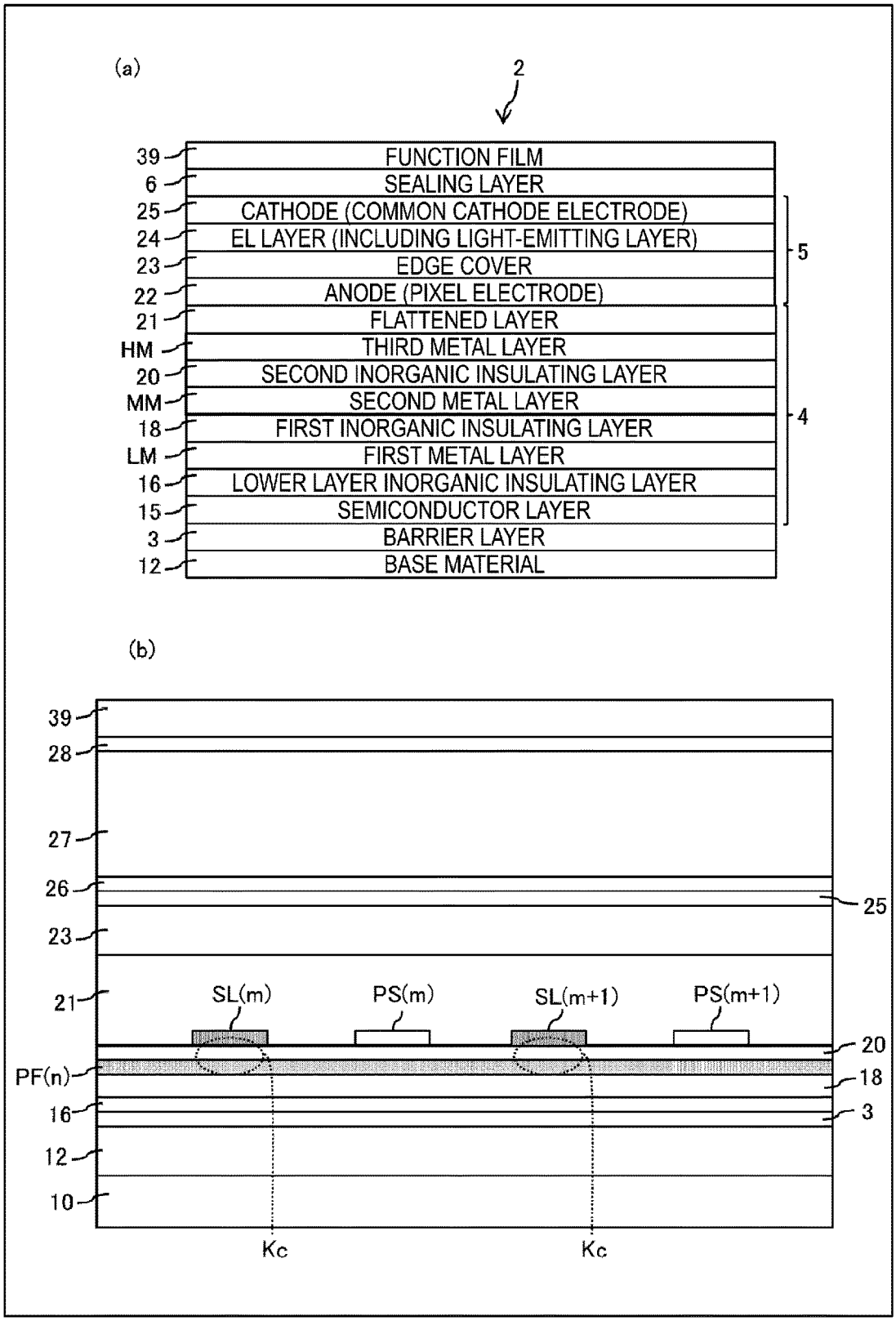
FIG. 2(*a*) is a schematic cross-sectional view illustrating a configuration of the display device according to the first embodiment, and FIG. 2(*b*) is a cross-sectional view including a data signal line and a first power supply voltage line.

FIG. 2(*a*) is a schematic cross-sectional view illustrating a configuration of a display device of a first embodiment, and FIG. 2(*b*) is a cross-sectional view including a data signal line and a first power supply voltage line. As illustrated in FIG. 2(*a*), a display device 2 is formed by layering a barrier layer 3, a TFT layer 4, a light-emitting element layer 5, a sealing layer 6, and a function film 39 in that order on a base material 12. After a layered body including the base material 12, the barrier layer 3, the TFT layer 4, the light-emitting element layer 5, and the sealing layer 6 is formed on a support substrate, the layered body is peeled from the support substrate, and a lower face film is bonded to a peeling face.

A glass substrate or a flexible resin substrate (for example, a polyimide substrate) can be used for the base material 12. The barrier layer 3 is a layer that prevents foreign matters such as water, oxygen, and a movable ion from entering the TFT layer 4 and the light-emitting element layer 5, and the barrier layer 3 can include a silicon oxide film, or a silicon nitride film that is formed by CVD, or a layered film of these films.

The TFT layer 4 is formed by layering a semiconductor layer 15, a lower layer inorganic insulating layer 16, a first metal layer LM, a first inorganic insulating layer 18, a second metal layer MM, a second inorganic insulating layer 20, a third metal layer HM, and a flattened layer 21 in that order.

The first metal layer LM includes a scanning signal line GL(n) and a light emission control line EM(n), the second metal layer MM includes a first power supply voltage line PF(n) and an initialization power source line Pi(n), and the third metal layer HM includes a data signal line SL(m) and a second power supply voltage line PS(m). Here, "including" means, for example, that the scanning signal line GL(n) and the light emission control line EM(n) are formed by the same process of film formation and patterning of the first metal layer LM.

Note that, as illustrated in FIG. 2(*b*), the first power supply voltage line PF(n) overlaps the data signal line SL(m) and the second power supply voltage line PS(m) via the second inorganic insulating layer 20. Particularly, the first power supply voltage line PF(n) and the second power supply voltage line PS(m) are not electrically connected at an intersection portion of the first power supply voltage line PF(n) and the second power supply voltage line PS(m) (a contact hole is not provided in the second inorganic insulating layer 20 at the intersection portion of the first power supply voltage line PF(n) and the second power supply voltage line PS(m)).

Amorphous silicon or low-temperature polysilicon (LTPS) can be used for the semiconductor layer 15. Each of the metal layers includes, for example, a single metal layer film or a multilayered metal film that includes at least one of aluminum, tungsten, molybdenum, tantalum, chromium, titanium, and copper. Each of the lower layer inorganic insulating layer 16, the first inorganic insulating layer 18, and the second inorganic insulating layer 20 includes, for example, a silicon oxide film or a silicon nitride film that is formed by CVD, or a layered film of these films. The flattened layer 21 (interlayer insulating film) includes, for example, a coatable organic material such as polyimide and an acrylic resin having a flattening effect.

The light-emitting element layer 5 is formed by layering a first electrode (anode 22), an edge cover (partition) 23 that covers an edge of the anode 22, an EL (electroluminescence) layer 24 (including a light-emitting layer), and a second electrode (cathode 25) in that order. That is, a light-emitting element ES includes the first electrode, the light-emitting layer, and the second electrode common to a plurality of the subpixels from the base material side. Here, the first electrode means an electrode in the TFT layer side, and the second electrode means an electrode common to the plurality of subpixels and formed in an upper layer of the first electrode. In the present example, the first electrode is the anode 22 and the second electrode is the cathode 25, but as described in the following example, the first electrode may be a cathode and the second electrode may be an anode. The edge cover 23 includes a coatable organic material such as polyimide and an acrylic resin, and the anode 22 is exposed in an opening of the edge cover 23. The anode 22 is a pixel electrode and the cathode 25 is a common electrode common to the plurality of subpixels.

The light-emitting element ES that is self-luminous (for example, an organic light emitting diode (OLED) or a quantum dot light emitting diode (QLED)) and that includes the anode 22, the EL layer 24, and the cathode 25 is provided in a subpixel PX. The light-emitting element ES is driven by various wiring lines (the scanning signal line GL(n), the data signal line SL(m), the light emission control line EM(n), and the like) and a pixel circuit PC that are formed in an upper layer of the TFT layer 4, and a current between the anode and the cathode is a value according to a data signal (a gray scale signal).

The EL layer 24 (also referred to as an active layer or a function layer) is formed by, for example, layering a hole injection layer, a hole transport layer, a light-emitting layer, an electron transport layer, and an electron injection layer in that order. The light-emitting layer is formed by vapor deposition, an ink-jet method, or the like, and overlaps the opening of the edge cover 23 that defines a light-emitting region. A configuration where one or more layers of the hole injection layer, the hole transport layer, the electron transport layer, and the electron injection layer are not formed can also be made.

In a case where a light-emitting layer of an OLED is formed by vapor deposition, a fine metal mask (FMM) is used. The FMM is a sheet including a large number of through-holes (for example, made of an invar material), and a light-emitting layer having an island shape (corresponding to one light-emitting element ES) is formed with an organic material passing through one of the through-holes.

As for a light-emitting layer of a QLED, for example, a light-emitting layer having an island shape (corresponding to one light-emitting element ES) can be formed by applying a solvent including diffused quantum dots to a quantum dot layer by ink-jet or by using a coater, and patterning the quantum dot layer by a photolithography method.

The anode 22 is constituted by, for example, layering indium tin oxide (ITO) and silver (Ag) or an alloy including Ag, and the anode 22 has light reflectivity. The cathode 25 can include a transparent conductive material such as an Mg—Ag alloy (ultrathin film), ITO, or indium zinc oxide (IZO).

In a case where the light-emitting element ES is an OLED, a positive hole and an electron recombine inside the light-emitting layer by a current between the anode 22 and the cathode 25, and in a process where the exciton thus generated transits to a ground state, light is emitted. Since the cathode 25 is transparent and the anode 22 has light reflectivity, light emitted from the EL layer 24 travels upward and top-emitting is realized.

In a case where the light-emitting element ES is a QLED, a positive hole and an electron recombine inside the light-emitting layer by a current between the anode 22 and the cathode 25, and in a process where the exciton thus generated transits from a conduction band level to a valence band level of a quantum dot, light is emitted (fluoresce).

A light-emitting element other than the OLED and QLED described above (an inorganic light emitting diode or the like) may be formed in the light-emitting element layer 5.

The sealing layer 6 is transparent, and includes an inorganic sealing film 26 that covers the cathode 25, an organic buffer film 27 formed in an upper layer overlying the inorganic sealing film 26, and an inorganic sealing film 28 formed in an upper layer overlying the organic buffer film 27. The sealing layer 6 that covers the light-emitting element layer 5 prevents foreign matters such as water, oxygen, and a movable ion from infiltrating the light-emitting element layer 5.

The inorganic sealing films 26 and 28 are each a transparent insulating film, and can include, for example, a silicon oxide film, or a silicon nitride film that is formed by CVD, or a layered film of these films. The organic buffer film 27 is a transparent organic film having a flattening effect and can be formed by applying a coatable organic material such as an acrylic resin by ink-jet.

The function layer 39 includes, for example, at least one of a protection function, an optical compensation function, and a touch sensor function.

Figure 3:
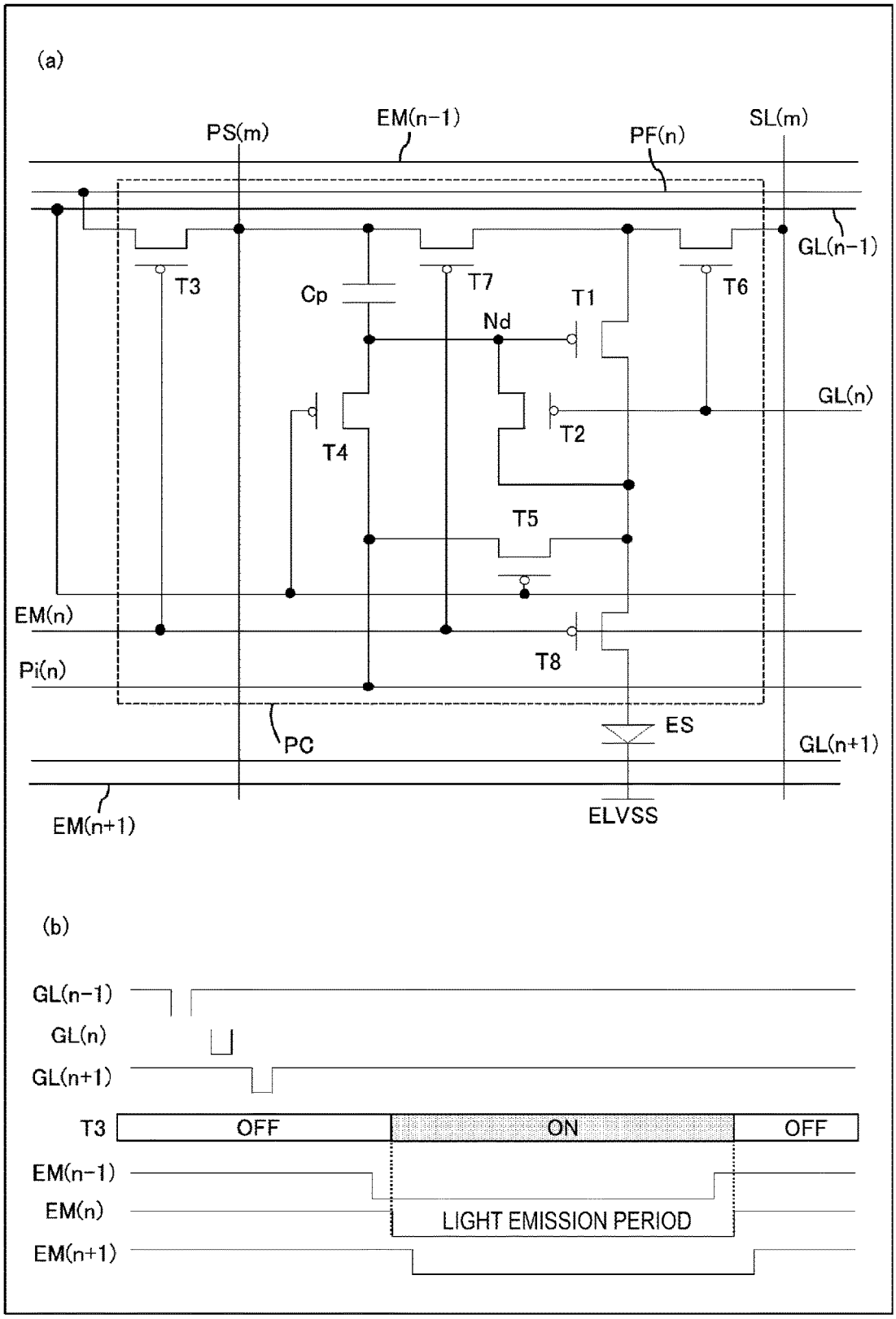
FIG. 3(*a*) is a circuit diagram illustrating a configuration of a subpixel of the first embodiment, and FIG. 3(*b*) is a flowchart illustrating an action of the subpixel.

FIG. 3(*a*) is a circuit diagram illustrating a configuration of the subpixel (the pixel circuit and the light-emitting element in an nth row and an mth column) of the first embodiment, and FIG. 3(*b*) is a flowchart illustrating an action of a display element. "Electrically connecting" means being in a conductive state with each other via a conductive material such as a metal material or a doped semiconductor layer without interposing a transistor. On the other hand, "being conductive" includes the case of being in a conductive state with each other via a channel with a transistor turned ON.

The pixel circuit PC of the subpixel PX includes a drive transistor T1, a threshold value compensation transistor T2, a power supply connection transistor T3, a first initialization transistor T4, a second initialization transistor T5, a writing transistor T6, a power supply transistor T7, a light emission control transistor T8, and a capacitor Cp. The transistors T1 to T8 are p-channel transistors. A first power supply voltage line PF and a second power supply voltage line PS are conductive with a first power supply ELVDD (the same power supply), and the cathode (the second electrode) is conductive with a second power supply ELVSS having a voltage lower than a voltage of the first power supply ELVDD.

The pixel circuit PC (n rows and m columns) will be described specifically with reference to FIG. 3(*a*).

One electrode of the capacitor Cp is electrically connected with a control terminal of the drive transistor T1, and the other electrode of the capacitor Cp is electrically connected to the second power supply voltage line PS(m).

The drive transistor T1 includes a first conduction terminal electrically connected to a first conduction terminal of the light emission control transistor T8, a second conduction terminal electrically connected to a second conduction terminal of the writing transistor T6, and the control terminal electrically connected to a node Nd and the one electrode of the capacitor Cp.

The threshold value compensation transistor T2 includes a first conduction terminal electrically connected to the first conduction terminal of the drive transistor T1, a second conduction terminal electrically connected to the control terminal of the drive transistor T1, and a control terminal electrically connected to the scanning signal line GL(n) of a host stage (the host stage means the nth row corresponding to the pixel circuit PC described).

The power supply connection transistor T3 includes a first conduction terminal electrically connected to the first power supply voltage line PF(n), a second conduction terminal electrically connected to the second power supply voltage line PS(m), and a control terminal electrically connected to the light emission control line EM(n) of the host stage.

The first initialization transistor T4 includes a first conduction terminal electrically connected to the control terminal of the drive transistor T1, a second conduction terminal electrically connected to the initialization power source line Pi(n), and a control terminal electrically connected to a scanning signal line GL(n−1) of a previous stage (the previous stage means a (n−1)th row).

The second initialization transistor T5 includes a first conduction terminal electrically connected to the first conduction terminal of the drive transistor T1, a second conduction terminal electrically connected to the initialization power source line Pi(n), and a control terminal electrically connected to the scanning signal line GL(n−1) of the previous stage. Note that the control terminal of the second initialization transistor T5 may be connected electrically to the scanning signal line GL(n) of the host stage.

The writing transistor T6 includes a first conduction terminal electrically connected to the data signal line SL(m) correspondingly, a second conduction terminal electrically connected to the second conduction terminal of the drive transistor T1, and a control terminal electrically connected to the scanning signal line GL(n) of the host stage.

The power supply transistor T7 includes a first conduction terminal electrically connected to the second conduction terminal of the drive transistor T1, a second conduction terminal electrically connected to the second conduction terminal of the drive transistor T1, the first conduction terminal electrically connected to the second power supply voltage line PS(m), and a control terminal electrically connected to the light emission control line EM(n) of the host stage.

The light emission control transistor T8 includes the first conduction terminal electrically connected to the first conduction terminal of the drive transistor T1, a second conduction terminal electrically connected to the first electrode (anode) of the light-emitting element ES, and a control terminal electrically connected to the light emission control line EM(n) of the host stage.

In the pixel circuit PC (n rows and m columns), in a select period of the scanning signal line GL(n−1) of the previous stage (a low period in which the scanning signal line GL(n−1) of the previous stage becomes active), the drive transistor T1, the first initialization transistor T4 and the second initialization transistor T5 are turned ON, and the node Nd and a drain terminal (the first conduction terminal) of the drive transistor T1 are conductive with the initialization power source line Pi(n) and are reset to an initialization voltage.

Then, in a select period of the scanning signal line GL(n) of the host stage (a low period in which the scanning signal line GL(n) of the host stage becomes active: a writing period of the pixel circuit PC), the power supply connection transistor T3, the first initialization transistor T4, the second initialization transistor T5, the power supply transistor T7 and the light emission control transistor T8 are turned OFF and the threshold value compensation transistor T2 and the writing transistor T6 are turned ON, and a data signal (a gray scale voltage) from the data signal line SL(m) is set to the node Nd via the writing transistor T6, the drive transistor T1 and the threshold value compensation transistor T2.

Then, in a select period of the light emission control line EM(n) of the host stage (a low period in which the light emission control line EM(n) of the host stage becomes active: a light emission period of the light-emitting element ES), the power supply connection transistor T3, the power supply transistor T7 and the light emission control transistor T8 are turned ON, and the threshold value compensation transistor T2, the first initialization transistor T4, the second initialization transistor T5, and the writing transistor T6 are turned OFF, and a current according to a voltage set to the node Nd flows to the light-emitting element ES, and the light-emitting element ES emits light at luminance according to the data signal.

In the writing period of the pixel circuit PC corresponding to the subpixel PX (n rows and m columns), an ON voltage is input to the scanning signal line GL(n) corresponding, and a data signal is input from the data signal line SL(m) corresponding via the writing transistor T6 and the threshold value compensation transistor T2 to the capacitor Cp, and the other electrode of the capacitor Cp is not conductive with the first power supply voltage line PF(n).

As illustrated in (a) and (b) of FIG. 3, in the light emission period of the light-emitting element ES corresponding to the subpixel PX (n rows), the ON voltage is input to the light emission control line EM(n) corresponding, and the other electrode of the capacitor Cp is conductive with the first power supply voltage line PF(n) via the power supply connection transistor T3.

In the present example, the control terminal of the power supply connection transistor T3 is electrically connected to the light emission control line EM(n) of the host stage, and thus in all the light emission period, the other electrode of the capacitor Cp is conductive with the first power supply voltage line PF(n) via the power supply connection transistor T3. In a modification described below, an example of a display device where, in the light emission period of the light-emitting element ES corresponding to the subpixel PX (nth row), and in at least a partial period of the light emission period, the other electrode of the capacitor is conductive with the first power supply voltage line PF(n) via the power supply connection transistor T3 will be described.

Figure 4:
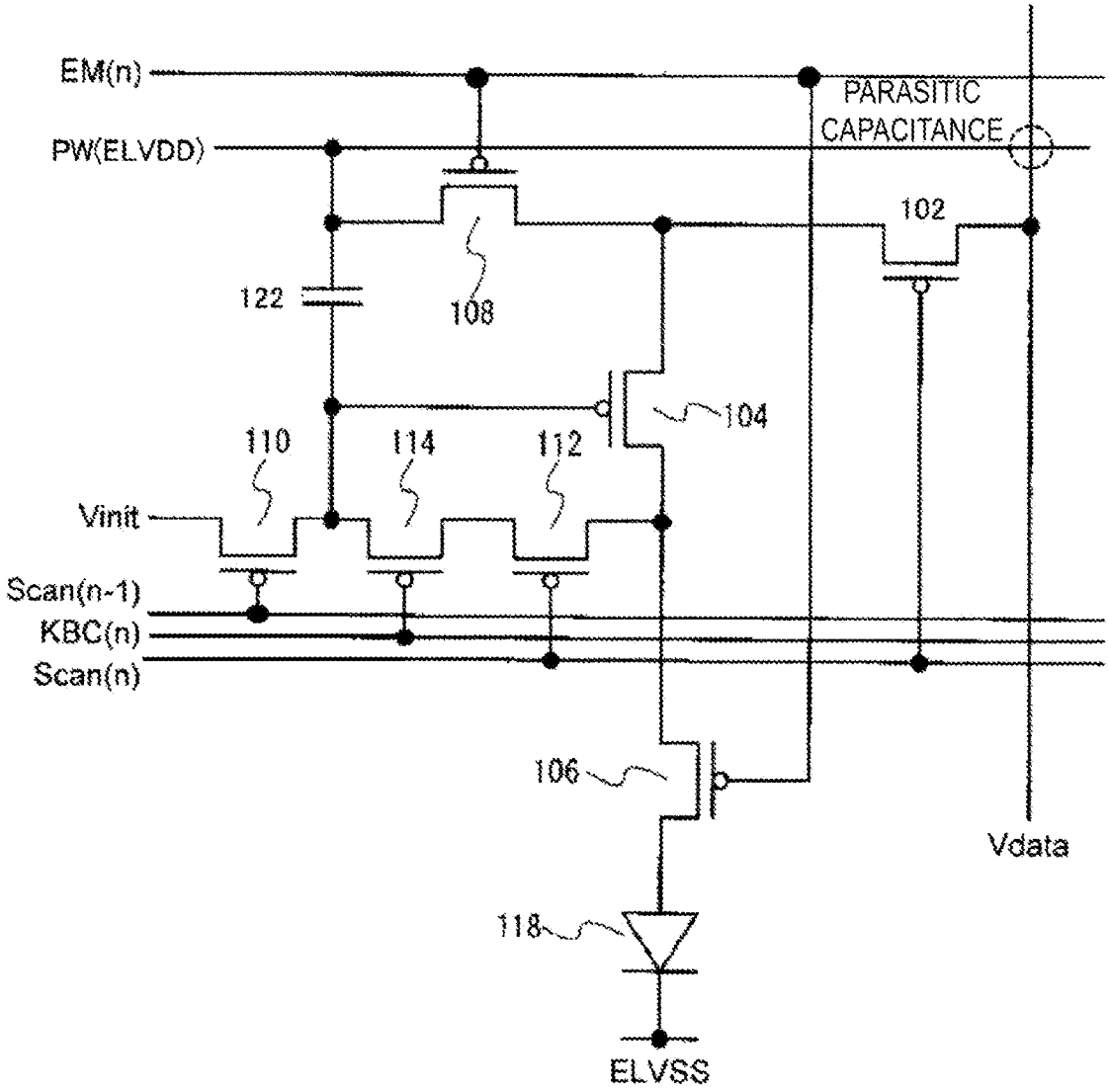
FIG. 4 is a circuit diagram illustrating a configuration of a pixel circuit of the related art.
Figure 5:
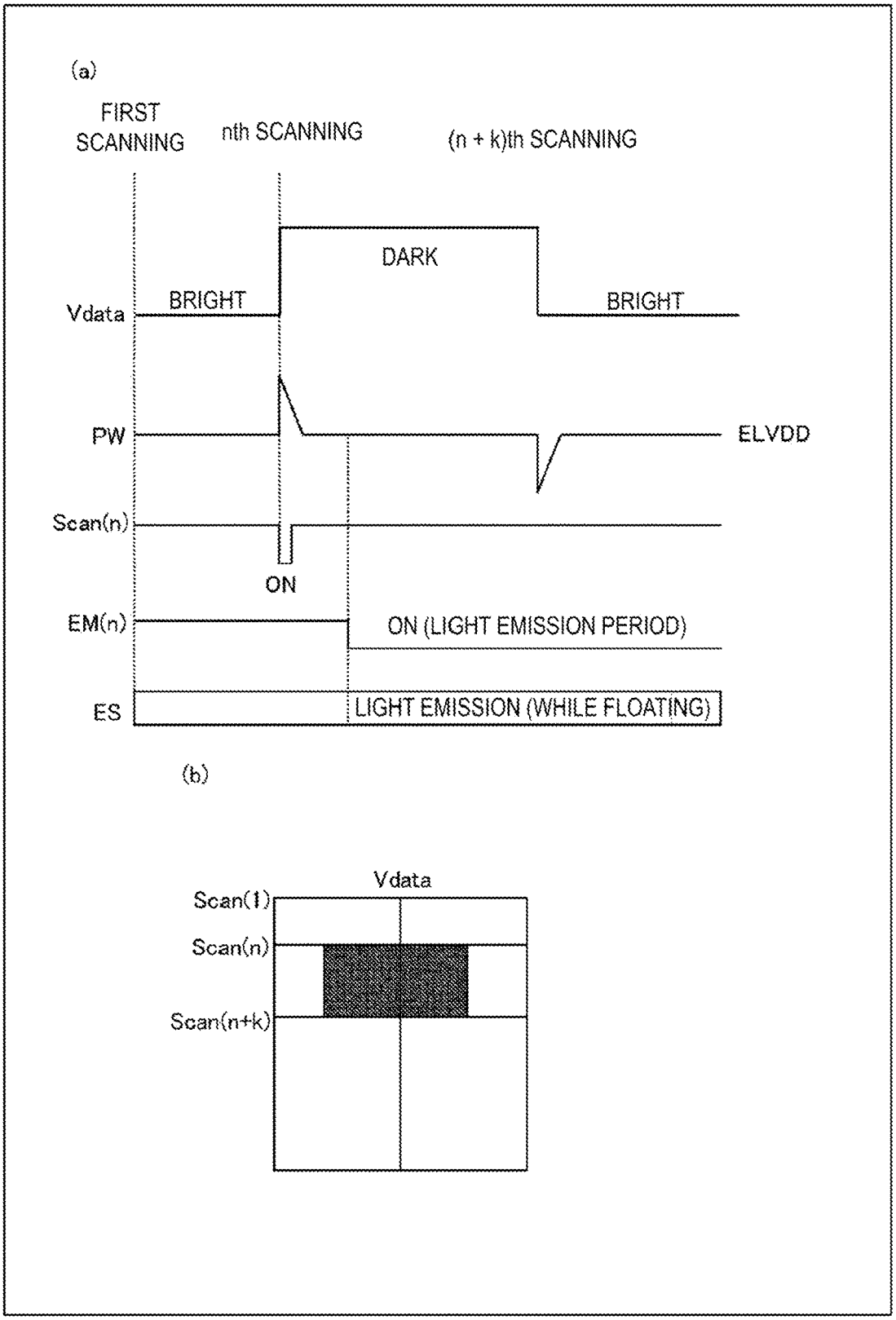
Prior Art FIG. 5
FIG. 5(*a*) is a flowchart explaining a problem of the pixel circuit of the related art, and FIG. 5(*b*) is a schematic plan view illustrating an example of a display pattern.

FIG. 4 is a circuit diagram illustrating a configuration of a pixel circuit of the related art. FIG. 5(*a*) is a flowchart explaining a problem of the pixel circuit-of the related art, and FIG. 5(*b*) is a schematic plan view illustrating an example of a display pattern. As illustrated in FIGS. 4 and 5, in the pixel circuit of the related art, due to parasitic capacitance between a power source line PW through which a power supply voltage (ELVDD) for the pixel circuit is supplied and a data line Vdata, a ripple occurs at potential of the power source line PW at the time of writing a data signal, and a data signal written in a capacitor 122 is different from a desired data signal. Accordingly, dark display floats and an outline blurs. On the other hand, at the time of writing in a subpixel that becomes a boundary from dark display to light display (a select period of Scan (n+k)), due to parasitic capacitance, light display is submerged and an outline blurs. This phenomenon is particularly likely to occur when a bright or dark block is displayed in a portion of a display region.

Figure 6:
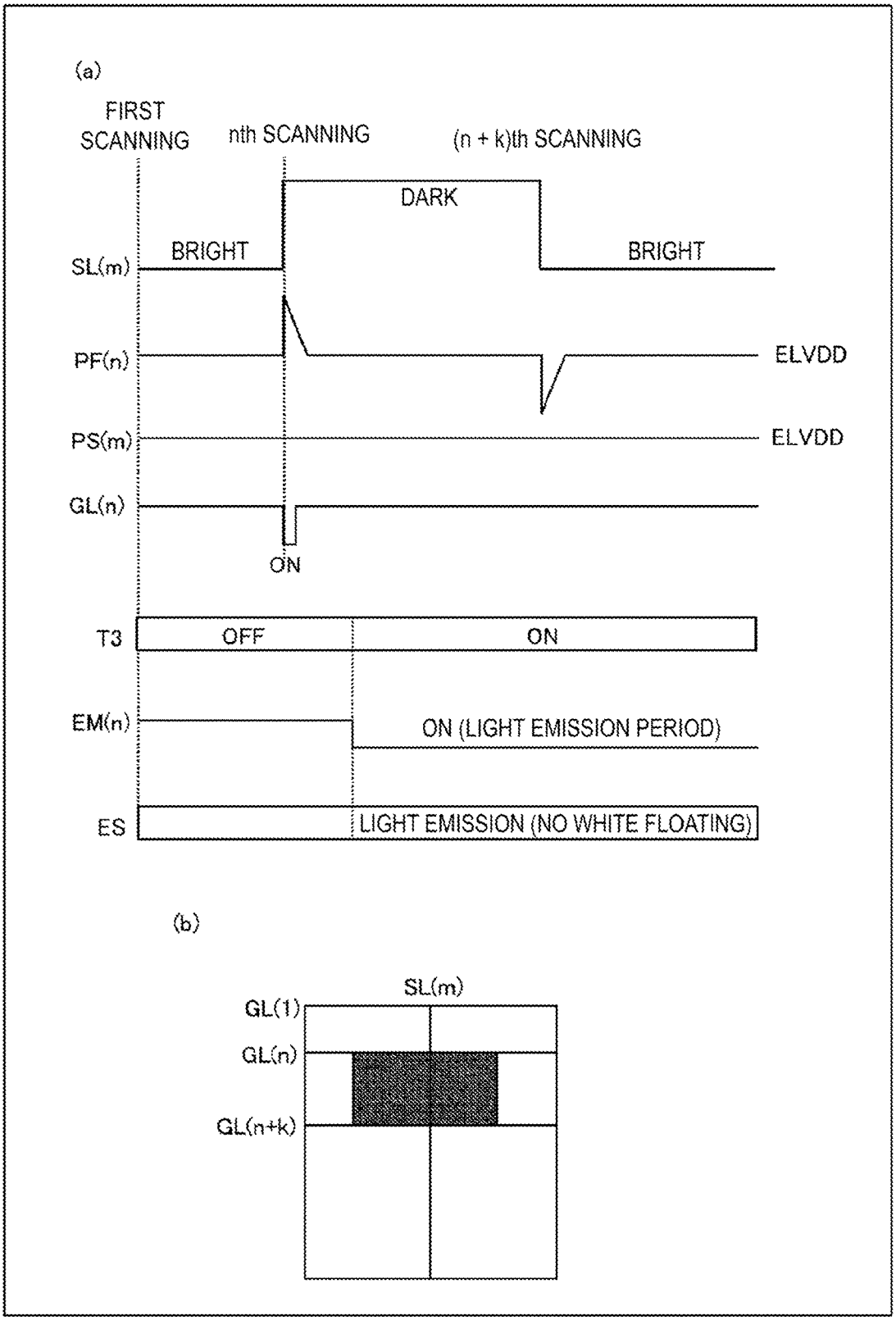
FIG. 6(*a*) is a flowchart illustrating an effect of the first embodiment, and FIG. 6(*b*) is a schematic plan view illustrating an example of a display pattern.

FIG. 6(*a*) is a flowchart explaining an effect of the first embodiment, and FIG. 6(*b*) is a schematic plan view illustrating an example of a display pattern. In the first embodiment, while the power supply connection transistor T3 is provided and the one electrode of the capacitor Cp is electrically connected to the node Nd, the other electrode is electrically connected to a drain terminal of the power supply connection transistor T3, and thus since the power supply connection transistor T3 is turned OFF in the writing period, the first power supply voltage line PF(n) is not conductive with the second conduction terminal of the drive transistor T1 and the other electrode of the capacitor Cp, and in the light emission period after the writing period, the power supply transistor T7 and the power supply connection transistor T3 are turned ON and are conductive with the second conduction terminal of the drive transistor T1 and the other electrode of the capacitor Cp.

As illustrated in FIG. 6(*a*), since there is no coupling (parasitic capacitance) with the data signal line SL(m), the second power supply voltage line PS(m) is flat. The other electrode of the capacitor Cp is electrically connected to the second power supply voltage line PS(m) at the time of writing, and thus is not affected by a ripple of the first power supply voltage line PF(n). Accordingly, appropriate display without white floating can be made in the light emission period.

In addition, in at least a partial period of the light emission period of the light-emitting element ES corresponding to the subpixel PX (n rows and m rows), the power supply voltage (ELVDD) is supplied from each of the first power supply voltage line PF(n) and the second power supply voltage line PS(m) to the second conduction terminal of the drive transistor T1, and a current flows to the light-emitting element ES via the first power supply voltage line PF(n) and the second power supply voltage line PS(m), and thus the drive capability of the light-emitting element ES increases.

In the example illustrated in FIG. 3(*b*), the control terminal of the power supply connection transistor T3 is electrically connected to the light emission control line EM(n) of the host stage, and thus in all the light emission period of the light-emitting element ES corresponding to the subpixel PX (n rows and m columns), the power supply voltage (ELVDD) is supplied from each of the first power supply voltage line PF(n) and the second power supply voltage line PS(m) to the second conduction terminal of the drive transistor T1, and a current flows to the light-emitting element ES via the first power supply voltage line PF(n) and the second power supply voltage line PS(m).

Figure 7:
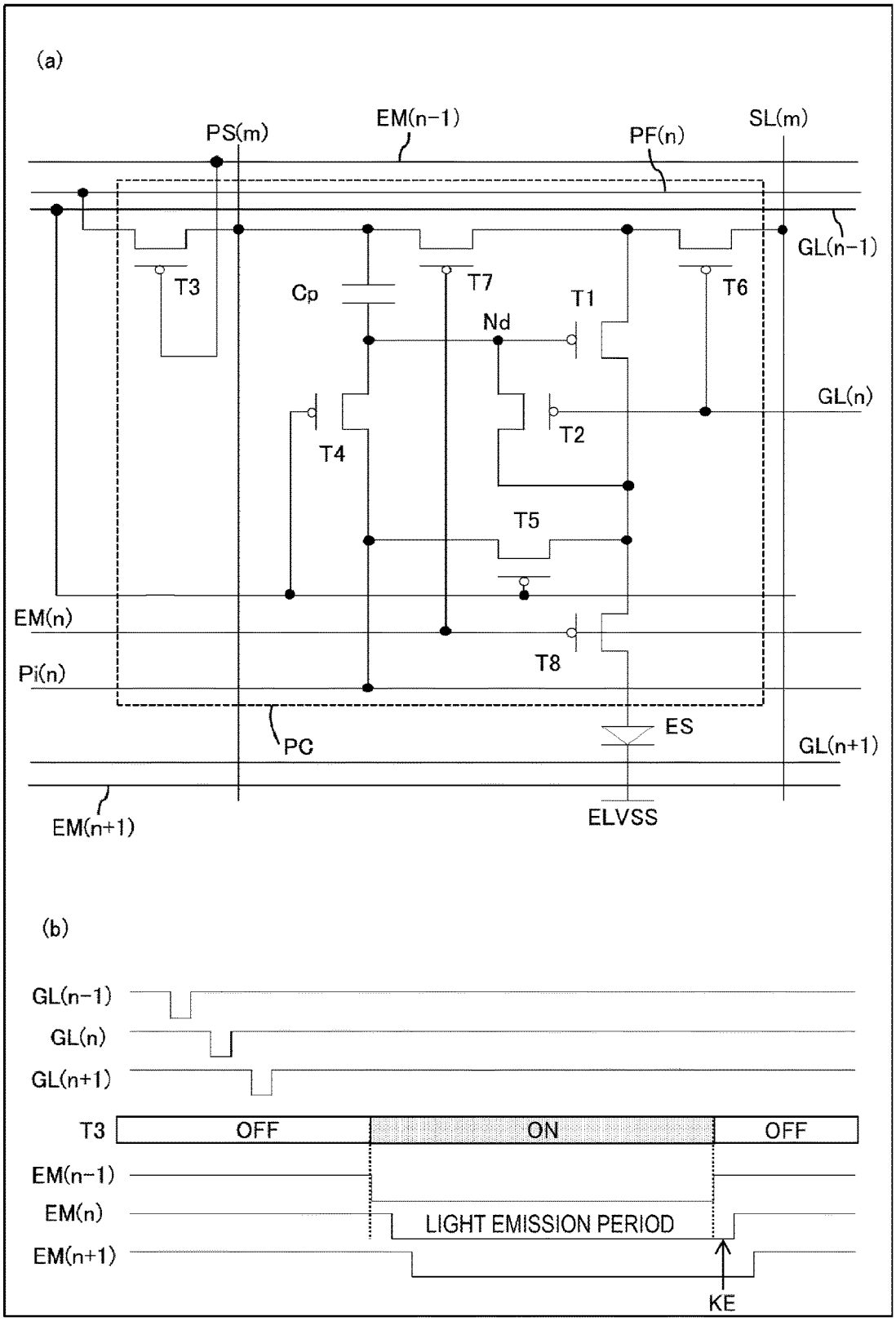
FIG. 7(*a*) is a circuit diagram illustrating another configuration of the subpixel of the first embodiment, and FIG. 7(*b*) is a flowchart illustrating an action of the subpixel.

FIG. 7(*a*) is a circuit diagram illustrating a modification of the subpixel of the first embodiment, and FIG. 7(*b*) is a flowchart illustrating an action of the subpixel. As illustrated in FIG. 7, a control terminal of a power supply connection transistor T3 is electrically connected to a light emission control line EM(n−1) of a previous stage.

In a light emission period of FIG. 7(*b*), except for a partial period KE that becomes a final period (that is, in at least a partial period of the light emission period), a first power supply voltage line PF(n) is conductive with the other electrode of a capacitor Cp and a second conduction terminal of a transistor T1 (the other electrode of the capacitor Cp is conductive with the first power supply voltage line PF(n)).

Figure 8:
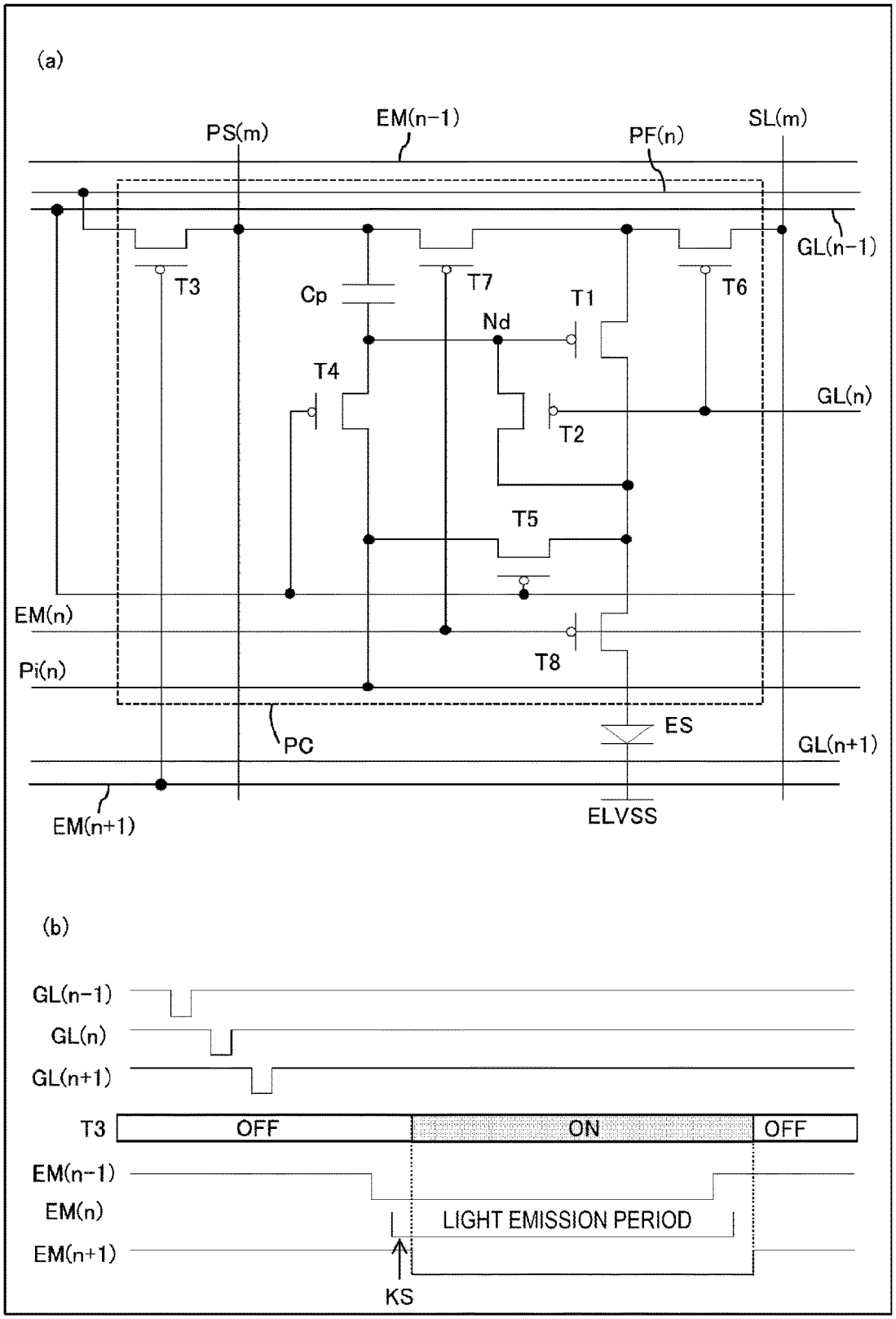
FIG. 8(*a*) is a circuit diagram illustrating still another configuration of the subpixel of the first embodiment, and FIG. 8(*b*) is a flowchart illustrating an action of the subpixel.

FIG. 8(*a*) is a circuit diagram illustrating still another modification of the subpixel of the first embodiment, and FIG. 8(*b*) is a flowchart illustrating an action of the subpixel. As illustrated in FIG. 8, in a case where an ON signal is not input to a light emission control line of a subsequent stage at the time of writing of a host stage, a control terminal of a power supply connection transistor T3 may be connected electrically to a light emission control line EM(n+1) of a subsequent stage.

In a light emission period of FIG. 8(*b*), except for a partial period KS that becomes an initial period (that is, in at least a partial period of the light emission period), a first power supply voltage line PF(n) is conductive with the other electrode of a capacitor Cp and a second conduction terminal of a transistor T1 (the other electrode of the capacitor Cp is conductive with the first power supply voltage line PF(n)).

Note that the examples and modifications described above can be selected appropriately by design or the like of the pixel circuit PC.

Second Embodiment

Figure 9:
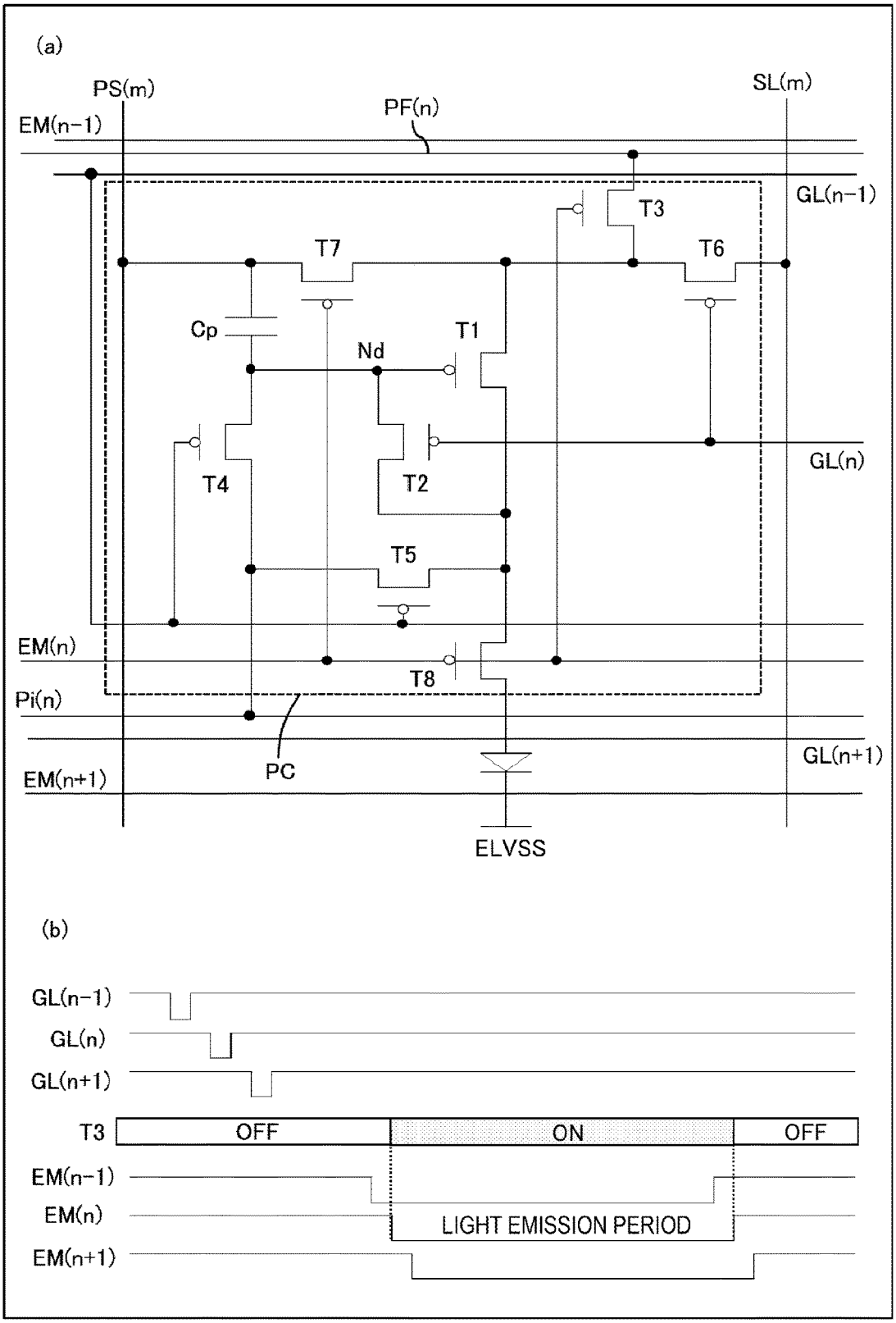
FIG. 9(*a*) is a circuit diagram illustrating a configuration of a subpixel of a second embodiment, and FIG. 9(*b*) is a flowchart illustrating an action of the subpixel.

FIG. 9(*a*) is a circuit diagram illustrating a configuration of a subpixel according to a second embodiment, and FIG. 9(*b*) is a flowchart illustrating an action of the subpixel. In FIG. 3, the other electrode of the capacitor Cp is electrically connected to the first power supply voltage line PF(n) via the power supply connection transistor T3, but the embodiment is not limited to this. As illustrated in FIG. 9, a second conduction terminal of a drive transistor T1 may be connected electrically to a first power supply voltage line PF(n) via a power supply connection transistor T3 (a second conduction terminal of the power supply connection transistor T3 is electrically connected to the second conduction terminal of the drive transistor T1).

In a pixel circuit PC (n rows and m columns), in a select period of a scanning signal line GL(n−1) of a previous stage, the drive transistor T1, a first initialization transistor T4, and a second initialization transistor T5 are turned ON, and a node Nd and a drain terminal (a first conduction terminal) of the drive transistor T1 are conductive with an initialization power source line Pi(n) and are reset to an initialization voltage.

In a select period of a scanning signal line GL(n) of a host stage, the power supply connection transistor T3, the first initialization transistor T4, the second initialization transistor T5, a power supply transistor T7, and a light emission control transistor T8 are turned OFF and the drive transistor T1, a threshold value compensation transistor T2 and a writing transistor T6 are turned ON, and a data signal (a gray scale voltage) from a data signal line SL(m) is set to the node Nd via the writing transistor T6, the drive transistor T1, and the threshold value compensation transistor T2.

Then, in a select period of a light emission control line EM(n) of the host stage, the power supply connection transistor T3, the power supply transistor T7, and the light emission control transistor T8 are turned ON and the threshold value compensation transistor T2, the first initialization transistor T4, the second initialization transistor T5 and the writing transistor T6 are turned OFF, and a current according to a voltage set to the node Nd flows to a light-emitting element ES, and the light-emitting element ES emits light at luminance according to the data signal.

In a writing period, the power supply transistor T7 and the power supply connection transistor T3 are turned OFF and the first power supply voltage line PF(n) is not conductive with the second conduction terminal (the source terminal) of the drive transistor T1 and the other electrode of a capacitor Cp, and in a light emission period after the writing period, the power supply transistor T7 and the power supply connection transistor T3 are turned ON and the first power supply voltage line PF(n) is conductive with the second conduction terminal (the source terminal) of the drive transistor T1 and the other electrode of the capacitor Cp.

As with the first embodiment, a control terminal of the power supply connection transistor T3 may be connected electrically to the light emission control line EM(n) of the host stage as illustrated in FIG. 9(*b*). In addition, as described in the first embodiment, the control terminal of the power supply connection transistor T3 may be connected electrically to a light emission control line EM(n−1) of the previous stage, or may be connected electrically to a light emission control line EM(n+1) of a subsequent stage.

Third Embodiment

Figure 10:
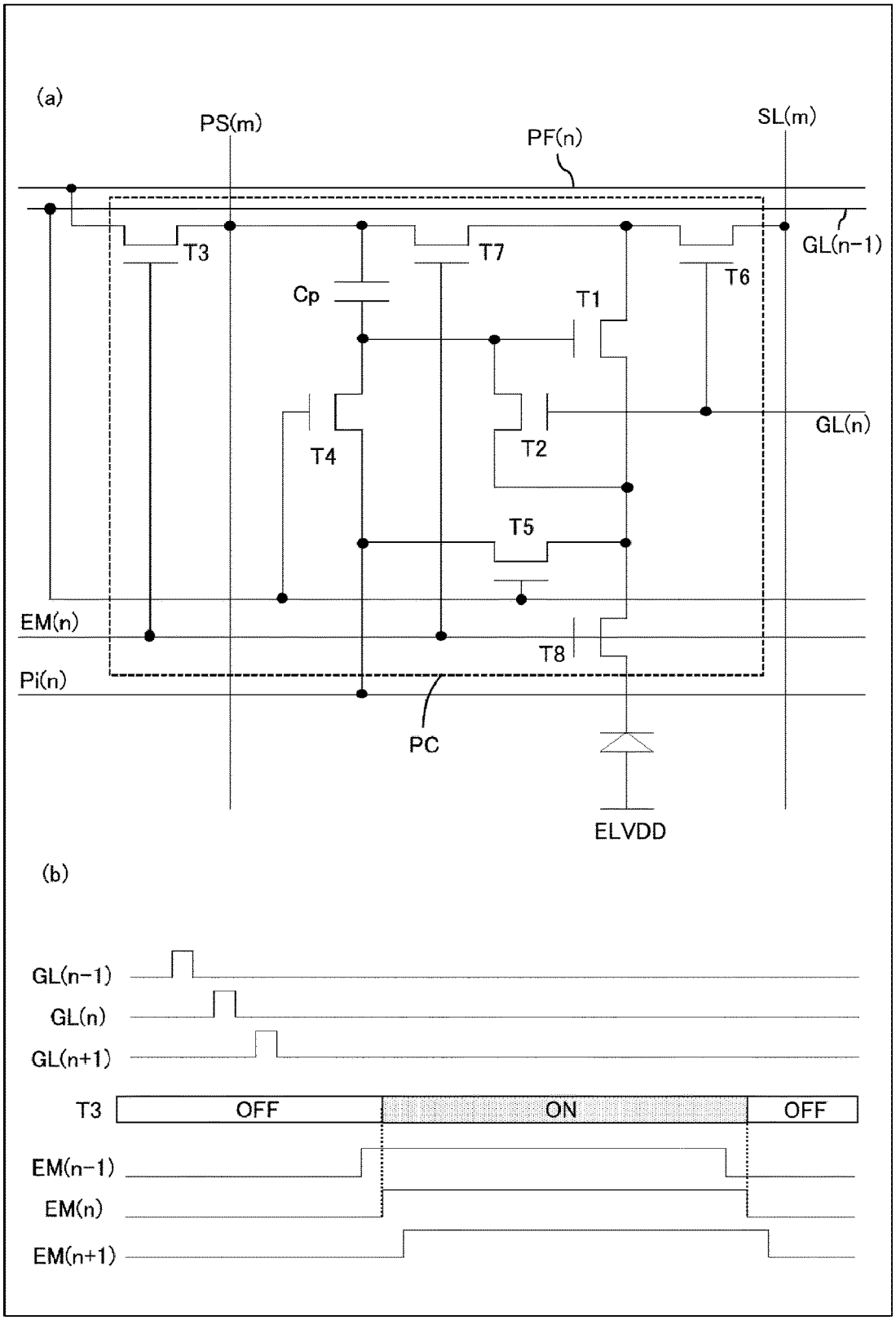
FIG. 10(*a*) is a circuit diagram illustrating a configuration of a subpixel of a third embodiment, and FIG. 10(*b*) is a flowchart illustrating an action of the subpixel.

FIG. 10(*a*) is a circuit diagram illustrating a configuration of a subpixel according to a third embodiment, and FIG. 10(*b*) is a flowchart illustrating an action of the subpixel. In the present example, a first electrode is a cathode that is a pixel electrode, and a second electrode is an anode common to a plurality of the subpixels.

Transistors T1 to T8 of FIG. 10 are each an N-channel transistor having a channel of an oxide semiconductor, for example, an In—Ga—Zn—O based semiconductor. A first power supply voltage line PF(n) and a second power supply voltage line PS(m) are conductive with a first power supply ELVSS (the same power supply), and the anode (the second electrode) is conductive with a second power supply ELVDD having a higher voltage than a voltage of the first power supply ELVSS.

In a pixel circuit PC (n rows and m columns), in a select period of a scanning signal line GL(n−1) of a previous stage (a high period in which the scanning signal line GL(n−1) of the previous stage becomes active), the drive transistor T1, the first initialization transistor T4 and the second initialization transistor T5 are turned ON, and a node Nd and a drain terminal (a first conduction terminal) of the drive transistor T1 are conductive with an initialization power source line Pi(n) and are reset to an initialization voltage.

Then, in a select period of a scanning signal line GL(n) of a host stage (a high period in which the scanning signal line GL(n) of the host stage becomes active: a writing period of the pixel circuit PC), the power supply connection transistor T3, the first initialization transistor T4, the second initialization transistor T5, the power supply transistor T7 and the emission control transistor T8 are turned OFF and the threshold value compensation transistor T2 and the writing transistor T6 are turned ON, and a data signal (a gray scale voltage) from a data signal line SL(m) is set to the node Nd via the writing transistor T6, the drive transistor T1, and the threshold value compensation transistor T2.

Then, in a select period of a light emission control line EM(n) of the host stage (a high period in which the light emission control line EM(n) of the host stage becomes active: a light emission period of a light-emitting element ES), the power supply connection transistor T3, the power supply transistor T7 and the light emission control transistor T8 are turned ON and the threshold value compensation transistor T2, the first initialization transistor T4, the second initialization transistor T5, and the writing transistor T6 are turned OFF, and a current according to a voltage set to the node Nd flows to the light-emitting element ES, and the light-emitting element ES emits light at luminance according to the data signal.

In the writing period, the power supply connection transistor T3 is turned OFF, and the first power supply voltage line PF(n) is not conductive with a second conduction terminal of the drive transistor T1 and the other electrode of a capacitor Cp, and in the light emission period after the writing period, the power supply transistor T7 and the power supply connection transistor T3 are turned ON, and the first power supply voltage line PF(n) is conductive with the second conduction terminal of the drive transistor T1 and the other electrode of the capacitor Cp.

As with the first embodiment, a control terminal of the transistor T3 may be connected electrically to the light emission control line EM(n) of the host stage, or may be connected electrically to a light emission control line EM(n−1) of the previous stage, or may be connected electrically to a light emission control line EM(n+1) of a subsequent stage.

Fourth Embodiment

Figure 11:
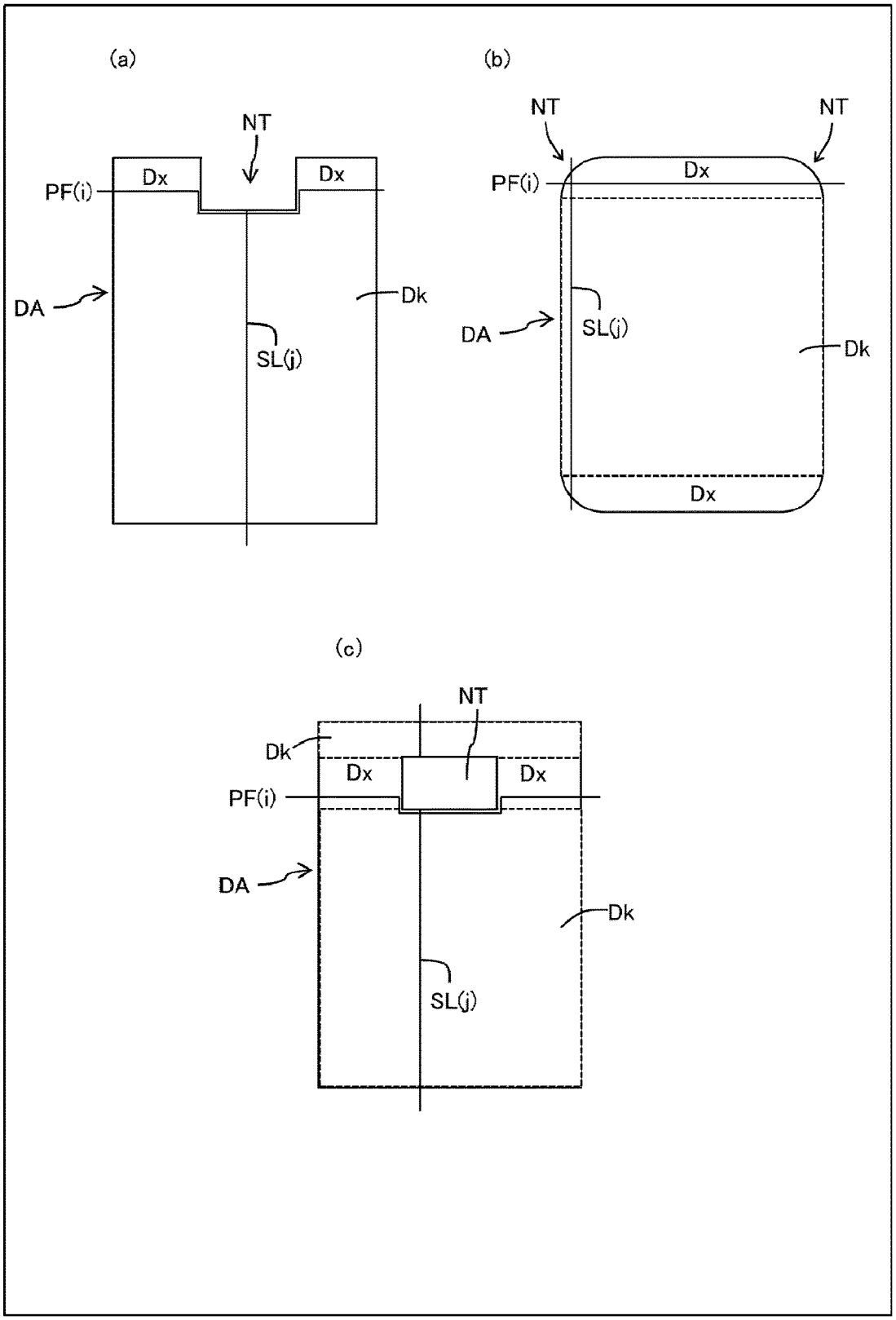
FIG. 11 is a schematic plan view illustrating a configuration of a display device of a fourth embodiment.

FIGS. 11(*a*) to 11(*c*) are schematic plan views illustrating a plurality of configurations of a display region DA of a fourth embodiment. A display device 2 includes a display region DA having an irregular shape and obtained by providing a notch portion NT in a portion of a rectangle. The display region DA of FIG. 11(*a*) has a shape in which the notch portion NT is provided in one side of the display region DA, and the display region DA of FIG. 11(*b*) has a shape in which the notch portion NT is provided at each of four corners of the display region DA (rounded corner), and the display region DA of FIG. 11(*c*) has a shape in which the notch portion NT (the notch portion NT may have a circular shape) is provided in the interior of the display region DA. Note that the notch portion NT of FIG. 11 is an example, and a shape obtained by combining those shapes may be used.

The display region DA will be described separately as for an irregular portion Dx including a first power supply voltage line PF intersecting the notch portion NT, and a normal portion Dk other than the irregular portion Dx. In the display region DA, the irregular portion Dx is a region where the irregular portion Dx is adjacent to the notch portion NT in the extension direction of a scanning signal line GL (the same as the extension direction of a first power supply voltage line PF(i)). Even in a case where the notch portion NT is formed, parasitic capacitance between the first power supply voltage line PF and a data signal line SL is made uniform in the irregular portion Dx and the normal portion Dk, and thus in FIGS. 11(*a*) and 11(*c*), the first power supply voltage line PF(i) intersecting the notch portion NT is bypassed and passes in a periphery of the notch portion NT. That is, in the configuration of each of FIGS. 11(*a*) and 11(*c*), the first power supply voltage line PF(i) intersecting the irregular portion Dx overlaps a data signal line SL(j) intersecting the irregular portion Dx. In FIG. 11(*c*), the data signal line SL(j) intersecting the irregular portion Dx is bypassed and passes in the periphery of the notch portion NT. In addition, in FIG. 11(*b*), the data signal line SL(j) intersecting the irregular portion Dx extends to a frame region where a pixel circuit is not provided, and overlaps the first power supply voltage line PF(i) intersecting the irregular portion Dx.

In a plurality of horizontal scan periods corresponding to the notch portion NT, there is no image signal to be displayed in the data signal line SL(j) intersecting the irregular portion Dx, and thus the data signal line SL(j) is continuously supplied with a data signal corresponding to black or white. Thus, a ripple (see FIG. 6) is likely to occur in the first power supply voltage line PF(i) intersecting the irregular portion Dx due to coupling with the data signal line SL(j) in a similar manner to the case where a bright or dark block is displayed in a portion of the display region DA.

Accordingly, when a power supply connection transistor T3 is provided in a pixel circuit PC alone corresponding to the first power supply voltage line PF(i) intersecting the irregular portion Dx, occurrence of a ripple can be prevented. In this case, the power supply connection transistor T3 may be provided in all the pixel circuits PC corresponding to the first power supply voltage line PF intersecting the irregular portion Dx, or may be provided in some of the pixel circuits PC. Further, in a case where the notch portion NT is provided in one side of the display region DA as illustrated in FIG. 11(*a*), the power supply connection transistor T3 may be provided in a pixel circuit alone corresponding to the first power supply voltage line PF(i) that is furthest from the one side in a first power supply voltage line PF(n) intersecting the irregular portion Dx. It is because the first power supply voltage line PF(i) is a wiring line where a ripple occurs most due to the data signal line SL(j). Similarly, in a case where the notch portion NT is provided in the interior of the display region DA as illustrated in FIG. 11(*c*), the power supply connection transistor T3 may be provided in a pixel circuit alone corresponding to the first power supply voltage line PF initially intersecting the irregular portion Dx, and corresponding to the first power supply voltage line PF finally intersecting the irregular portion Dx in the first power supply voltage line PF(n) intersecting the irregular portion Dx in a direction in which the data signal line SL(j) extends.

As a matter of course, as with the first embodiment, the power supply connection transistor T3 may be provided in all the pixel circuits.

The light-emitting element described above is an element having luminance and transmittance controlled by a current, and as a display device including the electric current-controlled light-emitting element, there are an organic electro luminescence (EL) display including an organic light emitting diode (OLED), an EL display such as an inorganic EL display including an inorganic light emitting diode, a quantum dot light emitting diode (QLED) display including a QLED, and the like.

Each of the embodiments described above is for the purpose of exemplification and description, and is not intended to limit. It is apparent to those skilled in the art that many variations can be made based on the exemplification and description.

SUPPLEMENT

First Aspect

A display device including a plurality of scanning signal lines, a plurality of light emission control lines, a plurality of first power supply voltage lines, a plurality of initialization power source lines, a plurality of data signal lines, and a plurality of second power supply voltage lines, wherein the plurality of scanning signal lines, the plurality of light emission control lines, the plurality of first power supply voltage lines, and the plurality of initialization power source lines extend in parallel, and each intersects the plurality of data signal lines and the plurality of second power supply voltage lines that extend in parallel, a plurality of subpixels each including a pixel circuit and a light-emitting element are provided corresponding to a plurality of intersection points of the plurality of scanning signal lines and the plurality of data signal lines, the light-emitting element includes a first electrode, a light-emitting layer, and a second electrode common to the plurality of subpixels, the pixel circuit includes a drive transistor, a threshold value compensation transistor, a power supply connection transistor, a writing transistor, and a capacitor, one electrode of the capacitor is electrically connected to a control terminal of the drive transistor, and the other electrode of the capacitor is electrically connected to each of the plurality of second power supply voltage lines, the power supply connection transistor includes a first conduction terminal electrically connected to each of the plurality of first power supply voltage lines, in a writing period of the pixel circuit, an ON voltage is input to a corresponding scanning signal line of the plurality of scanning signal lines, a data signal is input from a corresponding data signal line of the plurality of data signal lines to the capacitor via the writing transistor and the threshold value compensation transistor, and the other electrode of the capacitor is not conductive with each of the plurality of first power supply voltage lines, and in a light emission period of the light-emitting element, an ON voltage is input to a corresponding light emission control line of the plurality of light emission control lines, and in at least a partial period of the light emission period, the other electrode of the capacitor is conductive with each of the plurality of first power supply voltage lines via the power supply connection transistor.

Second Aspect

The display device according to the first aspect, for example, wherein the pixel circuit further includes a first initialization transistor, a second initialization transistor, a power supply transistor, and a light emission control transistor, the first initialization transistor includes a first conduction terminal electrically connected to the control terminal of the drive transistor and a second conduction terminal electrically connected to each of the plurality of initialization power source lines, the second initialization transistor includes a first conduction terminal electrically connected to a first conduction terminal of the drive transistor and a second conduction terminal electrically connected to each of the plurality of initialization power source lines, the writing transistor includes a first conduction terminal electrically connected to a corresponding data signal line of the plurality of data signal lines and a second conduction terminal electrically connected to a second conduction terminal of the drive transistor, the threshold value compensation transistor includes a first conduction terminal electrically connected to the first conduction terminal of the drive transistor and a second conduction terminal electrically connected to the control terminal of the drive transistor, and the light emission control transistor includes a first conduction terminal electrically connected to the first conduction terminal of the drive transistor, and a second conduction terminal electrically connected to the first electrode of the light-emitting element.

Third Aspect

The display device according to the second aspect, for example, wherein a control terminal of the power supply connection transistor is electrically connected to a light emission control line corresponding to a host stage of the plurality of light emission control lines.

Fourth Aspect

The display device according to the third aspect, for example, wherein, in all the light emission period, the other electrode of the capacitor is conductive with each of the plurality of first power supply voltage lines via the power supply connection transistor.

Fifth Aspect

The display device according to the second aspect, for example, wherein the control terminal of the power supply connection transistor is electrically connected to a light emission control line corresponding to a previous stage or a subsequent stage to the host stage of the plurality of light emission control lines.

Sixth Aspect

The display device according to the fifth aspect, for example, wherein, in the light emission period, except for a partial period that becomes an initial period or a partial period that becomes a final period, the other electrode of the capacitor is conductive with each of the plurality of first power supply voltage lines via the power supply connection transistor.

Seventh Aspect

The display device according to any one of the first to sixth aspects, for example, wherein a second conduction terminal of the power supply connection transistor is electrically connected to the other electrode of the capacitor.

Eighth Aspect

The display device according to any one of the first to sixth aspects, for example, wherein the second conduction terminal of the power supply connection transistor is electrically connected to the second conduction terminal of the drive transistor.

Ninth Aspect

The display device according to any one of the first to eighth aspects, for example, wherein the display device includes a base material, a first metal layer, a first inorganic insulating layer, a second metal layer, a second inorganic insulating layer, and a third metal layer are provided in order from the base material, the plurality of scanning signal lines and the plurality of light emission control lines are provided in the first metal layer, the plurality of first power supply voltage lines and the plurality of initialization power source lines are provided in the second metal layer, and the plurality of data signal lines and the plurality of second power supply voltage lines are provided in the third metal layer.

Tenth Aspect

The display device according to the ninth aspect, for example, wherein each of the plurality of first power supply voltage lines overlaps each of the plurality of data signal lines via the second inorganic insulating layer.

Eleventh Aspect

The display device according to any one of the first to tenth aspects, for example, wherein the drive transistor is a P-type transistor, and the first electrode is an anode.

Twelfth Aspect

The display device according to any one of the first to tenth aspects, for example, wherein the drive transistor is an N-type transistor, and the first electrode is a cathode.

Thirteenth Aspect

The display device according to any one of the first to twelfth aspects, for example, wherein the plurality of first power supply voltage lines and the plurality of second power supply voltage lines are conductive with the same power supply.

Fourteenth Aspect

The display device according to any one of the first to thirteenth aspects, for example, including a display region having an irregular shape and obtained by providing a notch portion in a portion of a rectangle, wherein the display region includes an irregular portion adjacent to the notch portion in an extension direction of the plurality of scanning signal lines, and each of the plurality of first power supply voltage lines intersecting the irregular portion and each of the plurality of data signal lines intersecting the irregular portion intersect each other.

Fifteenth Aspect

The display device according to the fourteenth aspect, for example, wherein the power supply connection transistor is provided in a pixel circuit alone corresponding to each of the plurality of first power supply voltage lines intersecting the irregular portion.

Sixteenth Aspect

The display device according to the fifteenth aspect, for example, wherein the notch portion is provided in one side of the display region, and the power supply connection transistor is provided in a pixel circuit alone corresponding to a first power supply voltage line furthest from the one side in the plurality of first power supply voltage lines intersecting the irregular portion.

Seventeenth Aspect

The display device according to the fifteenth aspect, for example, wherein the notch portion is provided in an interior of the display region, and the power supply connection transistor is provided in a pixel circuit alone corresponding to a first power supply voltage line initially intersecting the irregular portion of the plurality of first power supply voltage lines and corresponding to a first power supply voltage line finally intersecting the irregular portion of the plurality of first power supply voltage lines, with respect to a direction in which the plurality of data signal lines extend.

The invention claimed is:

1. A display device comprising:

a plurality of scanning signal lines;

a plurality of light emission control lines;

a plurality of first power supply voltage lines;

a plurality of initialization power source lines;

a plurality of data signal lines; and a plurality of second power supply voltage lines, wherein the plurality of scanning signal lines, the plurality of light emission control lines, the plurality of first power supply voltage lines, and the plurality of initialization power source lines extend in parallel, and each intersects the plurality of data signal lines and the plurality of second power supply voltage lines that extend in parallel, a plurality of subpixels each including a pixel circuit and a light-emitting element are provided corresponding to a plurality of intersection points of the plurality of scanning signal lines and the plurality of data signal lines, the light-emitting element includes a first electrode, a light-emitting layer, and a second electrode common to the plurality of subpixels, the pixel circuit includes a drive transistor, a threshold value compensation transistor, a power supply connection transistor, a writing transistor, and a capacitor, one electrode of the capacitor is electrically connected to a control terminal of the drive transistor, and the other electrode of the capacitor is electrically connected to each of the plurality of second power supply voltage lines, the power supply connection transistor includes a first conduction terminal electrically connected to each of the plurality of first power supply voltage lines, in a writing period of the pixel circuit, an ON voltage is input to a corresponding scanning signal line of the plurality of scanning signal lines, a data signal is input from a corresponding data signal line of the plurality of data signal lines to the capacitor via the writing transistor and the threshold value compensation transistor, and the other electrode of the capacitor is not conductive with each of the plurality of first power supply voltage lines, and in a light emission period of the light-emitting element, an ON voltage is input to a corresponding light emission control line of the plurality of light emission control lines, and in at least a partial period of the light emission period, the other electrode of the capacitor is conductive with each of the plurality of first power supply voltage lines via the power supply connection transistor.

2. The display device according to claim 1, wherein the pixel circuit further includes a first initialization transistor, a second initialization transistor, a power supply transistor, and a light emission control transistor, the first initialization transistor includes a first conduction terminal electrically connected to the control terminal of the drive transistor and a second conduction terminal electrically connected to each of the plurality of initialization power source lines, the second initialization transistor includes a first conduction terminal electrically connected to a first conduction terminal of the drive transistor and a second conduction terminal electrically connected to each of the plurality of initialization power source lines, the writing transistor includes a first conduction terminal electrically connected to a corresponding data signal line of the plurality of data signal lines and a second conduction terminal electrically connected to a second conduction terminal of the drive transistor, the threshold value compensation transistor includes a first conduction terminal electrically connected to the first conduction terminal of the drive transistor and a second conduction terminal electrically connected to the control terminal of the drive transistor, and the light emission control transistor includes a first conduction terminal electrically connected to the first conduction terminal of the drive transistor, and a second conduction terminal electrically connected to the first electrode of the light-emitting element.

3. The display device according to claim 2, wherein a control terminal of the power supply connection transistor is electrically connected to a light emission control line corresponding to a host stage of the plurality of light emission control lines.

4. The display device according to claim 3, wherein, in all the light emission period, the other electrode of the capacitor is conductive with each of the plurality of first power supply voltage lines via the power supply connection transistor.

5. The display device according to claim 2, wherein the control terminal of the power supply connection transistor is electrically connected to a light emission control line corresponding to a previous stage or a subsequent stage to the host stage of the plurality of light emission control lines.

6. The display device according to claim 5, wherein, in the light emission period, except for a partial period that becomes an initial period or a partial period that becomes a final period, the other electrode of the capacitor is conductive with each of the plurality of first power supply voltage lines via the power supply connection transistor.

7. The display device according to claim 1, wherein a second conduction terminal of the power supply connection transistor is electrically connected to the other electrode of the capacitor.

8. The display device according to claim 1, wherein the second conduction terminal of the power supply connection transistor is electrically connected to the second conduction terminal of the drive transistor.

9. The display device according to claim 1, wherein the display device includes a base material, a first metal layer, a first inorganic insulating layer, a second metal layer, a second inorganic insulating layer, and a third metal layer are provided in order from the base material, the plurality of scanning signal lines and the plurality of light emission control lines are provided in the first metal layer, the plurality of first power supply voltage lines and the plurality of initialization power source lines are provided in the second metal layer, and the plurality of data signal lines and the plurality of second power supply voltage lines are provided in the third metal layer.

10. The display device according to claim 9, wherein each of the plurality of first power supply voltage lines overlaps each of the plurality of data signal lines via the second inorganic insulating layer.

11. The display device according to claim 1, wherein the drive transistor is a P-type transistor, and the first electrode is an anode.

12. The display device according to claim 1, wherein the drive transistor is an N-type transistor, and the first electrode is a cathode.

13. The display device according to claim 1, wherein the plurality of first power supply voltage lines and the plurality of second power supply voltage lines are conductive with the same power supply.

14. The display device according to claim 1, comprising:

a display region having an irregular shape and obtained by providing a notch portion in a portion of a rectangle, wherein the display region includes an irregular portion adjacent to the notch portion in an extension direction of the plurality of scanning signal lines, and each of the plurality of first power supply voltage lines intersecting the irregular portion and each of the plurality of data signal lines intersecting the irregular portion intersect each other.

15. The display device according to claim 14, wherein the power supply connection transistor is provided in a pixel circuit alone corresponding to each of the plurality of first power supply voltage lines intersecting the irregular portion.

16. The display device according to claim 15, wherein the notch portion is provided in one side of the display region, and the power supply connection transistor is provided in a pixel circuit alone corresponding to a first power supply voltage line furthest from the one side in the plurality of first power supply voltage lines intersecting the irregular portion.

17. The display device according to claim 15, wherein the notch portion is provided in an interior of the display region, and the power supply connection transistor is provided in a pixel circuit alone corresponding to a first power supply voltage line initially intersecting the irregular portion of the plurality of first power supply voltage lines and corresponding to a first power supply voltage line finally intersecting the irregular portion of the plurality of first power supply voltage lines, with respect to a direction in which the plurality of data signal lines extend.

* * * * *